United States Patent [19]

Swarbrick

[11] Patent Number: 4,592,300

[45] Date of Patent: Jun. 3, 1986

[54] ANCHOR

[76] Inventor: Harley E. Swarbrick, 77 Smyth Road, Nedlands, Western Australia, Australia, 6009

[21] Appl. No.: 640,096

[22] Filed: Aug. 13, 1984

[51] Int. Cl.[4] ..... B63B 21/00

[52] U.S. Cl. ..... 114/302; 114/301; 114/303

[58] Field of Search ..... 114/293, 294, 301, 302, 114/303, 308, 309

[56] References Cited

U.S. PATENT DOCUMENTS

| | | | |
|---|---|---|---|
| 335,561 | 2/1986 | Burbank | 114/302 |
| 558,389 | 4/1896 | Holmes | 114/302 |
| 626,224 | 6/1949 | Crocker | 114/302 |
| 697,149 | 4/1902 | Kenney | 114/302 |
| 1,253,006 | 1/1918 | Cook | 114/302 |
| 1,372,259 | 3/1921 | Wenlock | 114/302 |
| 1,865,163 | 6/1932 | Bedell | 114/302 |
| 2,200,695 | 5/1940 | Kaut | 114/302 |
| 2,625,898 | 1/1953 | Southard | 114/302 |

*Primary Examiner*—Trygve M. Blix

*Assistant Examiner*—C. T. Bartz

*Attorney, Agent, or Firm*—Reising, Ethington, Barnard, Perry & Milton

[57] ABSTRACT

The present invention relates in one aspect to an anchor comprising a shank portion and a stock portion, the stock portion extending through a first aperture in the shank portion and extending laterally of the shank portion when in use, but being demountable so as to be removable from the first aperture in the shank entirely or so as to be moveable in the first aperture to a position where it can be orientated substantially in alignment with the shank, wherein the stock is fitted with a keeper which in the operative position of the stock, is engageable with a second aperture in the shank of the stock spaced from the first aperture, said keeper being provided with means to enable it to be retained in the second aperture. The present invention also relates to an anchor comprising a shank portion and a fluke portion wherein in the assembled condition of the anchor, the shank portion is mounted in an aperture in the fluke portion and the fluke portion and the shank portion can be disassembled when not required for use.

7 Claims, 4 Drawing Figures

ANCHOR

The present invention relates to an anchor.

In accordance with one aspect of the present invention there is provided an anchor comprising a shank portion and a fluke portion wherein in the assembled condition of the anchor, the shank portion is mounted in an aperture in the fluke portion and the fluke portion and the shank portion can be disassembled when not required for use.

In accordance with another aspect of the present invention there is provided an anchor comprising a shank portion and a stock portion, the stock portion extending through a first aperture in the shank portion and extending laterally of the shank portion when in use, but being demountable so as to be removable from the first aperture in the shank entirely or so as to be moveable in the first aperture to a position where it can be orientated substantially in alignment with the shank, wherein the stock is fitted with a keeper which in operative position of the stock, is engagable with a second aperture in the shank spaced from the first aperture, said keeper being provided with means to enable it to be retained in the second aperture.

The present invention will now be described, by way of example, with reference to the accompanying drawings, in which.

Figure 2:
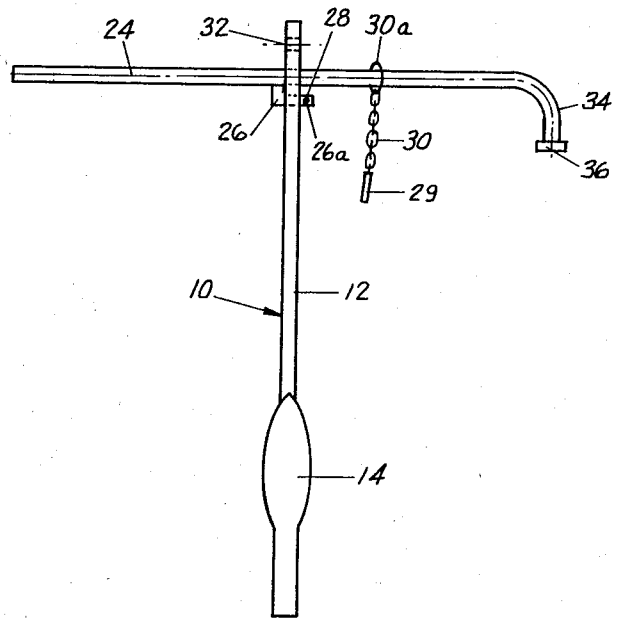
FIG. 2 is a side elevation of the anchor of FIG. 1 in assembled condition.

In the drawings, there is shown an anchor 10 of the admiralty type comprising a shank portion 12 and a fluke portion 14.

Figure 3:
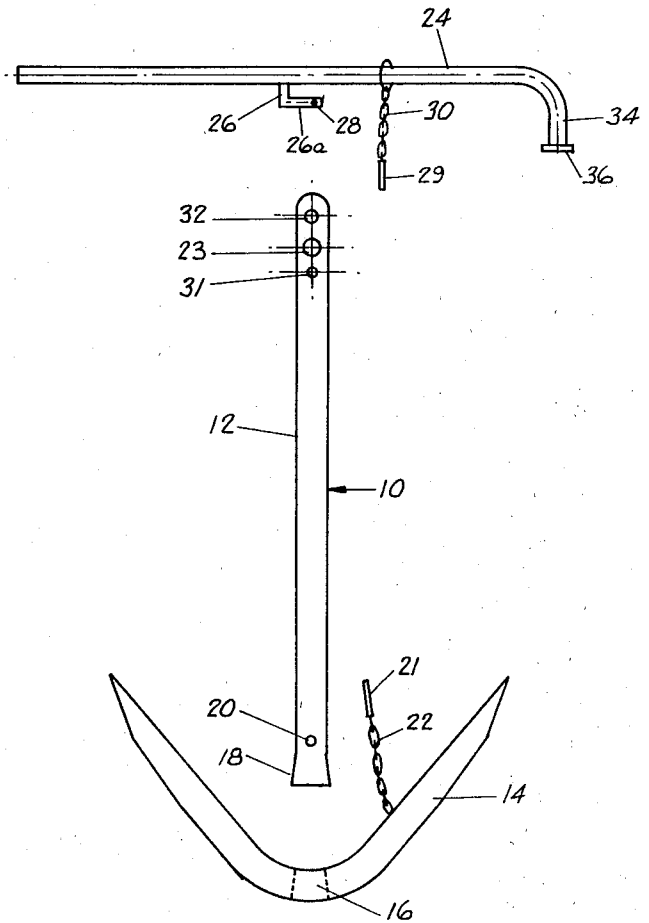
FIG. 3 is an exploded front elevation showing the component parts of the anchor of FIGS. 1 and 2 in disassembled condition.

The shank portion 12 is mounted in a rectangular section aperture 16 in the centre of the fluke portion 14 (see FIG. 3). To effect the mounting, the aperture 16 is tapered (as can be seen in FIG. 3) and the end of the shank 12 which fits in the aperture 16 is correspondingly tapered at 18. In the embodiment shown, the aperture 16 is tapered only on the sides which are side on in FIGS. 1 and 3 and can be seen in phantom in these figures, but it could be tapered on its other sides also. Also, whilst still being tapered it could have a round or ellipticle or other section. The shank portion 12 is engaged with the fluke portion 14 by inserting the end of the shank portion 12 remote from the tapered end 18 foremost into the aperture 16. The shank portion 12 is then passed through the aperture 16 unitl the tapered end 18 engages snugly with the aperture 16.

In use, it is found that the shank portion 12 remains firmly engaged with the fluke portion 14 and in general the shank portion 12 does not slide through the aperture 16 so that the aperture 16 and tapered end 18 become disengaged.

However, if desired the shank portion 12 can be provided with a small aperture 20 arranged to receive a stainless steel split pin 21 or similar locking pin means so as to prevent relative movement of the shank portion 12 relative to the fluke portion 14. The split pin 21 can be secured in known manner by splaying its free ends outwardly once it is located in the aperture 20. The split pin 21 may conveniently be attached to the fluke portion 14 by means of a chain 22 which prevents the pin 21 being lost or dropped in use. The chain 22 may be connected to the fluke portion 14 by being welded to the fluke portion 14.

Figure 1:
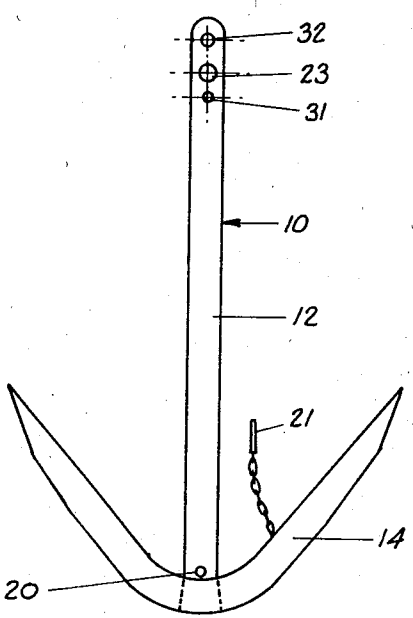
FIG. 1 is a front elevation of an anchor in accordance with the present invention in partly assembled condition but not including stock portion.

At the end remote from the tapered end 18 the shank portion 12 is provided with an aperture 23. The aperture 23 is arranged to receive a stock 24 which, as shown in FIG. 1, in use, extends laterally of the shank portion 12. The use of a stock is known and the stock 24 is designed to ensure that the fluke portion 14 remains side on to the sea bed or the like in use.

As can best be seen in FIG. 3, the stock 24 has a keeper or dowel 26 attached thereto such as by welding. The keeper 26 is a right angled member having an outer portion **26*a* extending parallel to the stock 24. The said outer portion 26*a* is provided adjacent its outer end with a small aperture 28 arranged to receive a stainless steel split pin 29 or similar locking pin means. The split pin 29 can also be secured by splaying its free ends outwardly once it is loaded in the aperture 28. Conveniently, the split pin 29 may be attached to the stock 24 by means of a chain 30 which prevents the pin 29 being lost or dropped in use. The chain 30 may be connected to the stock 24 by means of a stainless steel ring 30*a* which is slidably mounted on the stock 24 to enable the stock 24** to be moved to the demounted position shown in FIG. 4.

Further, the shank portion 12 comprises a second aperture 31 spaced from the first aperture 22 towards the tapered end 18 of the shank portion 12. The second aperture 31 is arranged to receive the outer portion of the keeper 26 when the stock 24 is engaged with the aperture 23 as can be seen in FIG. 2.

Further, the shank portion 12 comprises a third aperture 32 spaced from the first aperture 22 on the side thereof remote from the tapered end 18. A shackle (not shown) of known type may be placed about the aperture 32.

The shackle is arranged to have a chain or rope or the like attached to it.

Further, in the assembled condition as shown in FIG. 2, the split pin 29 or the like is inserted in the aperture 28 so that the keeper 26 is retained in the aperture 28 and cannot slip out of the aperture 28.

Figure 4:
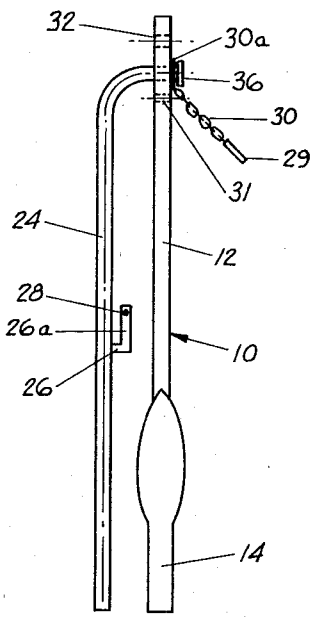
FIG. 4 is a side elevation of the anchor of FIGS. 1 and 2 with a stock portion in demounted condition.

Still further, as shown, the stock 24 is of a type which has an end 34 extending laterally from the remainder of the stock 24. The said laterally extending end 34 typically has a nut 36 or other abutment member attached to its free end. This prevents the said end 34 passing through the aperture 23. Thus, the stock 24 is not removable in its entirety from the shank portion 14 while the nut 36 is in place but is still demountable so as to lie substantially in alignment with the shank portion 12 in storage as shown in FIG. 4.

In use, the anchor 10 is assembled by passing the shank 12 through the aperture 16 until the tapered end 18 engages snugly with the aperture 16. Then the split pin 21 may be inserted and secured in the aperture 20 if present.

Subsequently, the stock 24 can be passed through the aperture 23 until the keeper 26 engages with the aperture 31. Then the split pin 29 is inserted and secured in the aperture 28 to firmly retain the keeper 26 in place in the aperture 28. By using the keeper 26 there is no need to interfere with the stock 24 in a way which could reduce its strength such as by cutting a slot in it as has been done in the past.

Further, a shackle can be placed about the aperture 32 and secured to the anchor 10 by a pin or the like in known manner, to attach the anchor 10 to a chain or the like.

When not required for use, the anchor 10 can be readily placed in the demounted condition shown in FIG. 4 by the reverse of the procedure described above. If it is desired to remove the stock 24 completely then the nut 36 can simply be removed from the stock 24 to enable the end portion 34 to pass completely through the aperture 23.

Modifications and variations such as would be apparent to a skilled addressee are deemed within the scope of the present invention. For example, the stock 24 need not have the portion 34 described above. It could be completely straight and be arranged to be removed completely from the shank 12 in the demounted condition of the anchor 10.

I claim:

1. An anchor comprising a shank portion, a fluke portion, a stock portion extending through a first aperture in the shank portion and extending laterally of the shank portion when in use, but being demountable so as to be removable from the first aperture in the shank portion entirely and so as to be movable in the first aperture to a position where it can be oriented substantially in alignment with the shank portion, wherein the shank portion contains a second aperture which is spaced from the first aperture in the shank portion, the stock portion is fitted with a keeper comprising an inner portion attached to and extending away from the stock portion and an outer portion attached to the inner portion, extending parallel to the stock portion and being spaced from the stock portion, the keeper in the operative position of the stock being engageable with the second aperture in the shank portion and the outer portion of the keeper being provided with means to enable the keeper to be retained in the second aperture.

2. An anchor according to claim 1, in which the outer portion of the keeper is provided with an aperture arranged to receive a locking pin when the keeper is located in the second aperture to retain the keeper in place in the second aperture.

3. An anchor according to claim 2, in which a locking pin is attached to the stock portion for insertion in the aperture in the keeper.

4. An anchor according to claim 1, in which the stock portion has a laterally extending end portion provided with an optionally removable abutment means to prevent the stock portion from passing entirely through the first aperture such that the stock portion can be moved to a demounted position in which it is oriented substantially parallel to the shank for storage.

5. An anchor according to claim 4, in which the outer portion of the keeper is provided with an aperture arranged to receive a locking pin when the keeper is located in the second aperture to retain the keeper in place in the second aperture and in which the locking pin is attached to the stock portion by means of a slidably mounted ring mounted about the stock portion between the abutment means and the shank.

6. An anchor according to claim 1, in which the shank portion is mounted in an aperture in a fluke portion and the fluke portion and shank portion can be disassembled apart from each other when not required for use.

7. An anchor according to claim 6, in which the shank portion contains an aperture adjacent the fluke portion, said aperture adjacent the fluke portion being arranged to receive a locking pin to prevent relative movement between the shank portion and the fluke portion.

* * * * *